US005127500A

United States Patent [19]

Mitchell

[11] Patent Number: 5,127,500

[45] Date of Patent: Jul. 7, 1992

[54] BRIEFCASE

[76] Inventor: Jerry Mitchell, 226 N. Water St., Milwaukee, Wis. 53202

[21] Appl. No.: 732,777

[22] Filed: Jul. 19, 1991

[51] Int. Cl.[5] ..... B65D 33/06

[52] U.S. Cl. ..... 190/115; 16/110.5; 190/902

[58] Field of Search ..... 190/107, 110, 115, 902; 229/117.24; 16/110.5; 24/115 K, 265 AL, 265 CD; 411/427; 220/94 R

[56] References Cited

U.S. PATENT DOCUMENTS

| | | | |
|---|---|---|---|
| 1,129,967 | 3/1915 | Eiseman | 190/115 |
| 1,633,991 | 6/1927 | Lifton | 190/115 |
| 2,113,159 | 4/1938 | Moxley | 411/427 |
| 2,205,259 | 6/1940 | Harbison | 220/94 R |
| 2,554,215 | 5/1951 | Schell et al. | 190/115 |
| 2,728,937 | 1/1956 | Shapiro | 16/110.5 |
| 2,925,841 | 2/1960 | Brunner | 190/115 |
| 2,928,153 | 3/1960 | Reiter | 24/115 K |
| 3,221,848 | 12/1965 | O'Neil | 220/94 R |
| 3,447,195 | 6/1969 | Bush | 190/115 |
| 3,782,620 | 1/1974 | Eichholz | 229/117.24 |

FOREIGN PATENT DOCUMENTS

| | | | |
|---|---|---|---|
| 870762 | 6/1961 | United Kingdom | 190/115 |

*Primary Examiner*—Gary E. Elkins

*Attorney, Agent, or Firm*—Michael, Best & Friedrich

[57] ABSTRACT

A briefcase includes a body portion defining a receptacle and having an open top, a flap formed of a pliable material and extending over the open top for closing the same, a handle, and an anchor at each end of the handle secures the handle to the flap. A back-up plate is mounted in the flap and extends over substantially the entire area thereof and is formed of a metallic material which is relatively stiffer than the material forming the flap. The anchors include a fastener extending through the flap and the back-up plate for fastening the handle to the back-up plate for supporting the case.

1 Claim, 1 Drawing Sheet

BRIEFCASE

BACKGROUND OF THE INVENTION

This invention relates to briefcases and more particularly to a handle support assembly for briefcases.

One type of briefcase is formed of a relatively pliable leather and includes an envelope type body and a closure flap. Such cases also often include a handle attached to the closure flap by rivets. When the case contains heavy papers or other objects and it is being supported by its handle, the weight is concentrated in the handle anchors. This causes the closure flap to distort and places a substantial strain on the anchor rivets. Further, if such handle assemblies should fail, they are relatively difficult to repair.

SUMMARY OF THE INVENTION

It is an object of the invention to provide a new and improved handle assembly for envelope type briefcases.

A further object of the invention is to provide a handle assembly for envelope type briefcases in which the weight is distributed over the entire closure flap.

Yet another object of the invention is to provide a handle assembly for envelope type briefcases which is easy to repair and replace.

These and other objects and advantages of the present invention will become more apparent from the detailed description thereof taken with the accompanying drawings.

In general terms, the invention comprises a briefcase including a body portion defining a receptacle and having an open top, a flap extending over the open top for closing the same, a handle, anchoring means at each end of the handle for securing the handle to the flap, the flap being formed of a pliable material. A back-up plate is mounted in the flap and extends therein over substantially the entire area thereof, the back-up plate being relatively stiffer than the material forming the flap. The anchoring means includes fastening means extending through the material and the back-up plate for fastening the handle to the back-up plate for supporting the case.

DETAILED DESCRIPTION OF THE PREFERRED EMBODIMENT

Figure 1:
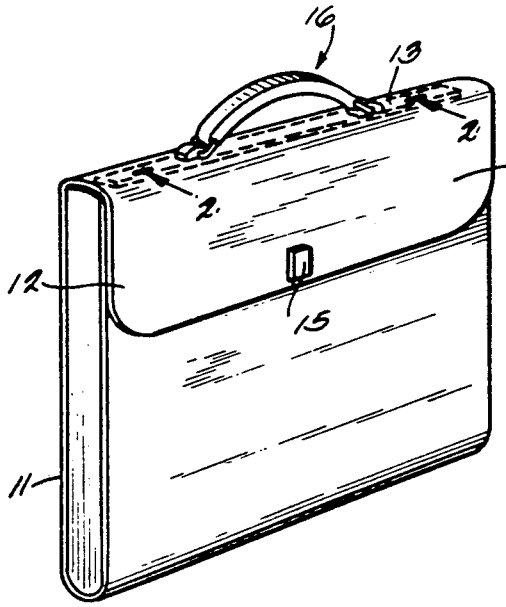
FIG. 1 is a perspective view showing a briefcase incorporating the present invention.

FIG. 1 shows a briefcase 10 having an envelope-type body 11 and a closure flap 12. The flap 12 includes a top portion 13 which extends across the open upper end of the body 11 and a side portion 14 which extends downwardly across the front of the body 11. A latch 15 or other securing device, such as one or more straps (not shown) is provided at the lower end of the flap 12 for securing the same in a closed position. A handle assembly 16 is mounted on the upper portion 13 of the flap 12 for supporting the case 10 and its contents.

Figure 2:
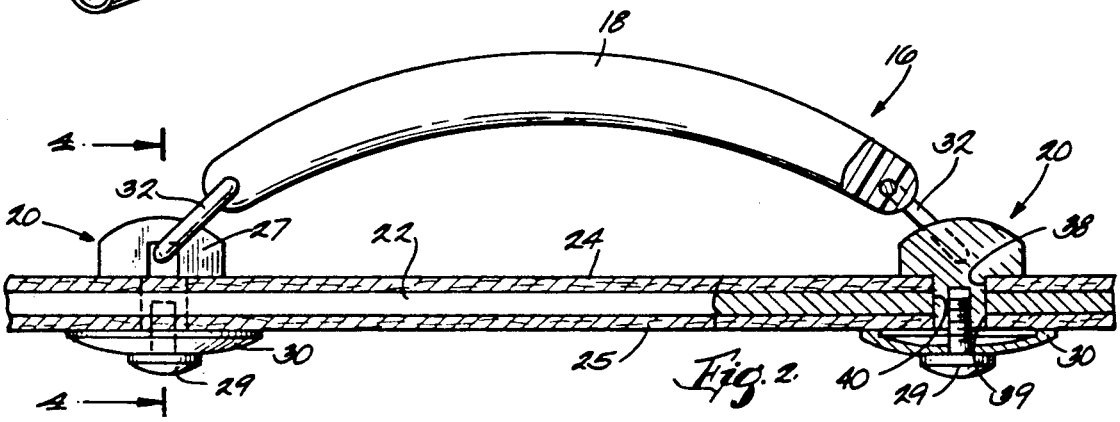
FIG. 2 is an enlarged, fragmentary view, with parts broken away, illustrating the handle assembly of FIG. 1 in greater detail.
Figure 3:
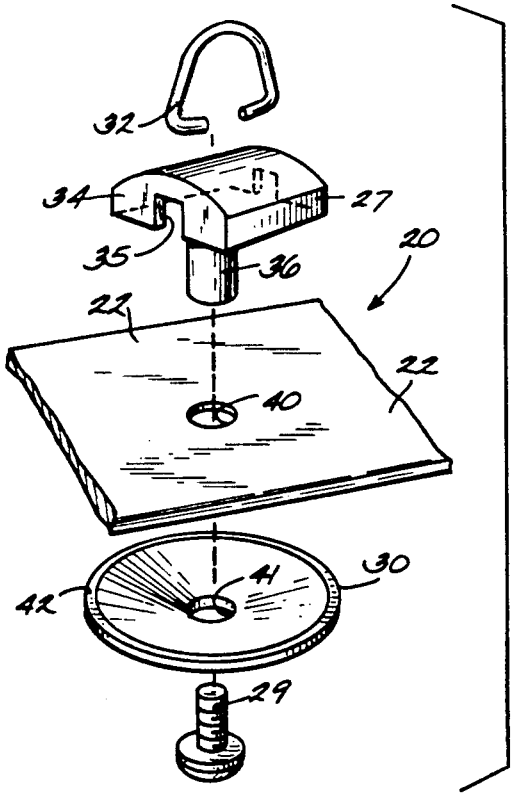
FIG. 3 is an exploded perspective view illustrating a portion of the handle assembly of FIG. 2.

The handle assembly includes a handle 18, anchoring assemblies 20 and a metallic support strip 22. As seen in FIGS. 1 and 2, the metallic support strip is disposed between the upper and lower layers of leather or other pliable material 24 and 25 from which the flap 12 is formed. The strip extends substantially from one end of the flap to the other and has a width slightly smaller than that of the top portion 13. The strip may have some resiliency, but is preferably of a relatively stiff material, such as steel.

The anchor assemblies 20 are identical and each includes an anchor member 27, a screw 29, a dished washer 30 and a D-ring 32. Each anchor member 27 includes a body portion 34 having a pair of slots 35 formed in each of its sides and a stem 36 extending downwardly from the body portion 34 and having an internally threaded bore 37.

Figure 4:
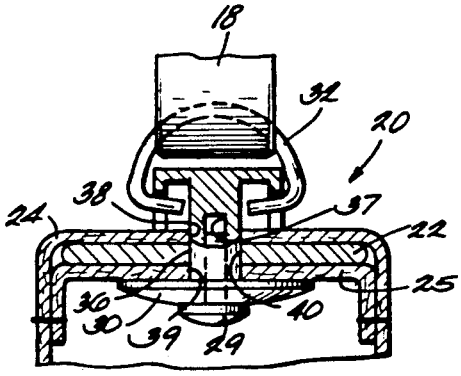
FIG. 4 is a view taken along lines 4—4 of FIG. 3.

In assembly, the strip 22 is placed between the material 24 and 25 before they are joined to form the flap 12. The D-rings 32 are passed through the openings in the ends of handle 18 and their ends are received within the slots 35 as shown in FIG. 4. The stems 36 are then passed downwardly through aligned openings 38 and 39 in the material 24 and 25, opening 40 in the strip 22 and the center opening 41 in the washer 30. The screw 29 is then threaded into the bore 34 and tightened to secure the handle 18 in position on the flap 14. The washer 30 has an annular upper rim 42 which is pressed against the undersurface of the material 25 as the screw 29 is tightened.

The strip 22 distributes the weight of the case 10 and its contents over the entire area of the flap top portion 13. As a result, the stress is not localized in the area where the handle 18 is secured, so that there is no sag or deformity of the flap 14 when the case is full and is supported by the handles 18. Furthermore, if the handle assembly should become damaged, it can easily be repaired or replaced by removing the screws 29.

While only a single embodiment of the invention has been illustrated and described, it is not intended to be limited thereby but only by the scope of the appended claims.

I claim:

1. A briefcase including a body portion defining a receptacle and having an open top, a flap extending over the open top for closing the same, a handle, anchoring means at each end of said handle for securing said handle to said flap, said flap being formed of a pliable material, a back-up plate mounted in said flap and extending therein over substantially the entire area thereof, said flap comprising upper and lower layers of pliable material, said back-up plate being formed of a metallic material and being disposed between said layers, said back-up plate and each of said layers having a pair of spaced apart holes formed therein, each hole in said back-up please being aligned with one of the holes in said layers, said back-up plate being relatively stiffer than the material forming said layers, said anchoring means including a first pair of threaded members disposed in spaced apart relation on the upper surface of said flap, said handle being coupled at its opposite ends to said first threaded members, a second pair of threaded members extending from below said flap and through aligned holes in said layers and said back-up plate for threadably engaging said first threaded members, respectively, to releasably secure said handle to said flap, washer means disposed between said second threaded members and the lower layer of pliable material and engaging said material in surrounding relation to the holes formed therein for distributing the stress from said handle over a larger area than that defined by the second pair of threaded members.

* * * * *